United States Patent [19]

Walsh

[11] Patent Number: 4,722,437

[45] Date of Patent: Feb. 2, 1988

[54] PACKAGE ALIGNMENT SYSTEM

[75] Inventor: Joseph C. Walsh, Longmont, Colo.

[73] Assignee: Adolph Coors Company, Golden, Colo.

[21] Appl. No.: 830,356

[22] Filed: Feb. 18, 1986

[51] Int. Cl.[4] ..... B65D 75/00

[52] U.S. Cl. ..... 206/170; 206/175; 206/188; 229/41 B; 229/52 BC

[58] Field of Search ..... 206/170, 174, 175, 180, 206/188, 191, 427; 229/28 BC, 41 R, 41 B, 52 BC

[56] References Cited

U.S. PATENT DOCUMENTS

| | | | |
|---|---|---|---|
| 3,208,633 | 9/1965 | Graser . | |
| 3,567,069 | 3/1971 | Harrelson . | |
| 3,754,680 | 8/1973 | Wood | 229/52 BC |
| 3,827,550 | 8/1974 | Arneson | 229/52 BC |
| 4,258,844 | 3/1981 | Stout | 229/52 BC |
| 4,319,682 | 3/1982 | Wright et al. | 206/180 |
| 4,345,711 | 8/1982 | Fischer | 229/41 R |
| 4,450,956 | 5/1984 | Wood | 206/188 |
| 4,465,181 | 8/1984 | Wood | 206/188 |
| 4,509,640 | 4/1985 | Joyce | 229/41 B |
| 4,610,349 | 9/1986 | Schwartz et al. | 206/180 |

*Primary Examiner*—David T. Fidei

*Attorney, Agent, or Firm*—Klaas & Law

[57] ABSTRACT

A system for aligning portions of a carrier blank during the folding of a carrier blank into a folded carrier wherein an abutment tab having an abutment edge is provided in one portion of the carrier blank with the one portion having a first linear edge and wherein an abutment edge is provided in a second portion of the carrier blank with the second portion having a second linear edge so that when the first and second portions of the carrier blank are moved into adjacent relationship, the abutment edges move into a contacting relationship to guide the first and second linear edges into a superposed and aligned relationship.

5 Claims, 8 Drawing Figures

PACKAGE ALIGNMENT SYSTEM

FIELD OF THE INVENTION

This invention relates generally to a carrier blank that is passed through a series of operations so as to form a folded carrier that can be readily filled with products, such as cans or bottles, and more particularly to a carrier blank that may be readily folded in a series of operations so as to form a multi-cell, basket type carrier having the various portions thereof in proper alignment.

BACKGROUND OF THE INVENTION

In the manufacture of carriers used to package products, such as multi-cell, basket type carriers for cans or bottles containing liquids or other similar materials from paperboard materials, it is customary to use a sheet of continuous length of the paperboard material. The sheet of continuous length is processed through conventional apparatus to form a plurality of carrier blanks having cut, fold and score lines therein. The carrier blanks are then processed through conventional apparatus wherein the carrier blanks are folded in a series of operations to form folded carriers. It is customary to form folded carriers from the carrier blanks at the rate between about 350 and 400 folded carriers per minute.

One of the problems associates with forming folded carriers from carrier blanks at these rates of production is that of ensuring that the various portions of the folded carrier are in proper alignment. The apparatus for inserting the cans or bottles in to the folded carriers operates at substantially the same rates of speed at which the carriers are formed. This apparatus is designed with structures that are adapted to receive portions of the folded carrier at specific locations. If these portions of the folded carriers are not at these specific locations because of a misalignment of these portions, the production line must be shut down. At the above rates of speed, it is readily apparent that any production downtime resulting from a misalignment of portions of the folded carrier is very serious.

BRIEF DESCRIPTION OF THE INVENTION

This invention provides method and structure for use when folding carrier blanks into folded carriers wherein an alignment system is provided so that the various portions of the folded carrier are in proper alignment.

In a preferred embodiment of the invention, a carrier blank having oppositely facing planar surfaces is provided with an abutment tab comprising a pair of intersecting cuts and an associated fold line. Conventional means are used to move a portion of the abutment tab to a position projecting out of one of the planar surfaces so as to form a linear abutment edge. The carrier blank is folded so that the abutment edge is located in a first portion of the folded blank having a first linear edge. The folded blank also has a second portion having a linear abutment edge and a second linear edge adapted to be positioned in superposed an parallel relationship with the first linear edge. The folding of the carrier blank is continued to produce relative movement between the first and second portions. During this relative movement, conventional folding means are used to apply a skewing force to the first or second portion to ensure that there is constact between the linear edges. The relative movement is continued and the abutment edge guide the the first and second linear edges to a final position wherein the first and second linear edges are in the desired superposed and parallel relationship.

It is an object of this invention to provide method and structure to ensure that the various portions of a folded carrier are in proper alignment.

It is another object of this invention to provide method and structure to form an abutment edge in a carrier blank as the carrier blank is being folded which abutment edge cooperates with a linear edge of a partially folded carrier to ensure proper alignment of the various portions of the folded carrier.

Additional objects, advantages and novel features of the invention are set forth in part in the description which follows which will be understood or may be learned by practice of the invention. The objects and advantages of the invention may be realized and obtained by means of the instrumentalities and combinations particularly pointed out in the appended claims.

DETAILED DESCRIPTION OF THE INVENTION

Figure 1:
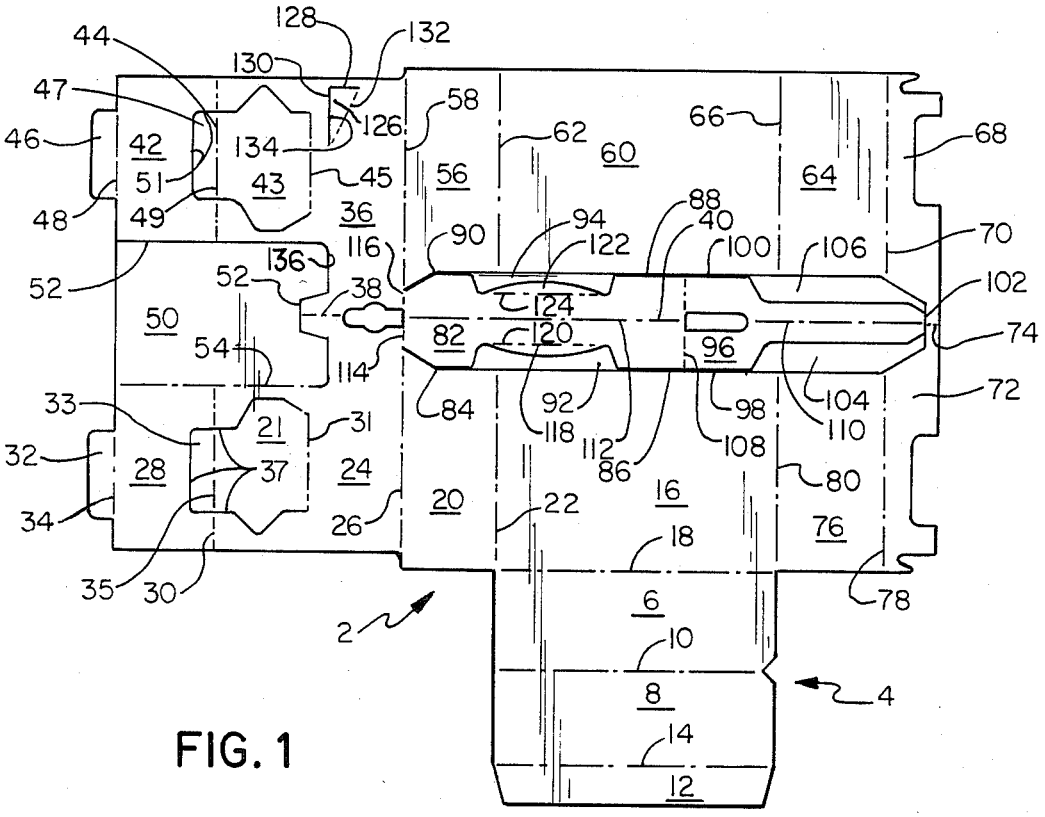
FIG. 1 is a plan view of a carrier blank illustrating one embodiment of the invention.

Referring to the drawings, FIG. 1 illustrates a one-piece carrier blank 2 of paperboard material, preferably a composite material, such as that described in U.S. Pat. No. 4,254,173 issued to A. D. Peer, Jr., having glue patterns, fold lines and cut lines illustrated in a conventional manner. A bottom wall panel 4 comprising two sections 6 and 8 connected by a fold line 10 is provided with a glue tab 12 connected to section 8 by the fold line 14. The section 6 of the bottom wall panel 4 is connected to a side wall panel 16 by a fold line 18. An end wall panel 20 is connected to side wall panel 16 by fold line 22 and to a riser panel 24 by fold line 26. A partition panel 28 is connected to the riser panel 26 by fold line 30 and is provided with a glue tab 32 connected thereto by fold line 34. Another partition panel 29 is connected to riser panel 24 by fold line 31 and is provided with a glue tab 33 conected thereto by a fold line 35. A cut line 39 permits the partition panel 29 to be partially separated from the riser panel 24. The riser panel 24 is connected to another similarly shaped riser panel 36 by a fold line 38 which is part of a center fold line 40 extending across the carrier blank 2. A partition panel 42 is connected to the risesr panel 36 by fold line 44 and is provided with a glue tab 46 connected thereto by fold line 48. Another partition panel 43 is connected to the riser panel 36 by fold line 45 and is provided with a glue tab 47 connected thereto by fold line 49. A cut line 51 permits the partition panel 43 to be partially separated from the riser panel 36.

A reinforcing tab 50 is formed in riser panels 24 and 36 and partition panel 42 by cut line 52 and is connected to riser panel 24 and partition panel 28 by a combination cut and fold line 54.

An end wall panel 56, similar in shape to end wall 20 is connected to riser panel 36 by fold line 58 and to side wall panel 60 by fold line 62. An end wall panel 64 is connected to side wall panel 60 by fold line 66 and is connected to a riser panel 68 by fold line 70. The riser panel 68 is connected to a similarly shaped riser panel 72 by fold line 74. An end wall panel 76, similar in shape to end wall panel 64, is connected to riser panel 72 by fold line 78 and to side wall panel 16 by fold line 80.

A handle portion 82 is formed in the carrier blank 2 by cut lines 84, 86, 88 and 90 and openings 92 and 94 are cut out of the carrier blank 2. A tongue portion 96, for reinforcing the handle 82 as described below, is formed in the carrier blank 2 by cut lines 98, 100 and 102 and openings 104 and 106 are cut out of the carrier blank 2. The tongue portion 96 is connected to the handle portion 82 by a fold line 108. A part 110 of the center fold line 40 is formed in the tongue portion 96 and a part 112 of the center fold line 40 is formed in the handle portion 82. The riser panel 24 is connected to the handle portion 82 by fold line 114 and the riser panel 36 is connected to the handle portion 82 by a fold line 116. A tab 118 is connected to the handle portion 82 by fold line 120 and a tab 122 is connected to the handle portion 82 by fold line 124.

A significant part of this invention comprises an abutment tab 126 formed in riser panel 36 by linear cut lines 128 and 130 and connected to riser panel 36 by fold line 132. The linear cut line 130 functions to form a linear abutment edge 134 on the abutment tab 126 for a purpose described below.

Figure 2:
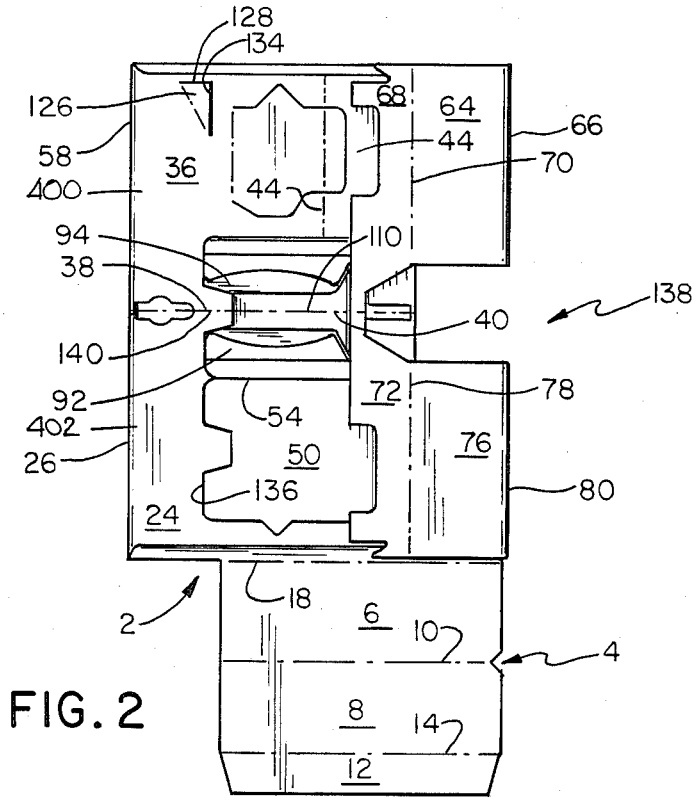
FIG. 2 is a plan view after a plurality of folds have been made in the carrier blank of FIG. 1.

The partially folded carrier 138 illustrated in FIG. 2 is formed by a sequence of severing and folding operations (not illustrated). The partially folded carrier 138 comprises a first portion 400 having a generally planar surface formed by the riser panel 36, the riser panel 68 and the end wall panel 64 and a second portion 402 having a generally planar surface formed by the riser panel 24, the riser panel 72 and the end wall panel 76. The first and second portions 400 and 402 are joined together by fold lines 38, 40 and 74. The reinforcing tab 50 is superposed over the riser panel 24 so that the linear abutment edge 136 is provided. During the sequence of severing and folding operations, the abutment tab 126 is severed along linear cut lines 128 and 130 and partially folded around fold line 132 so as to project outwardly and form the linear abutment edge 134, as illustrated in FIG. 3.

Figure 3:
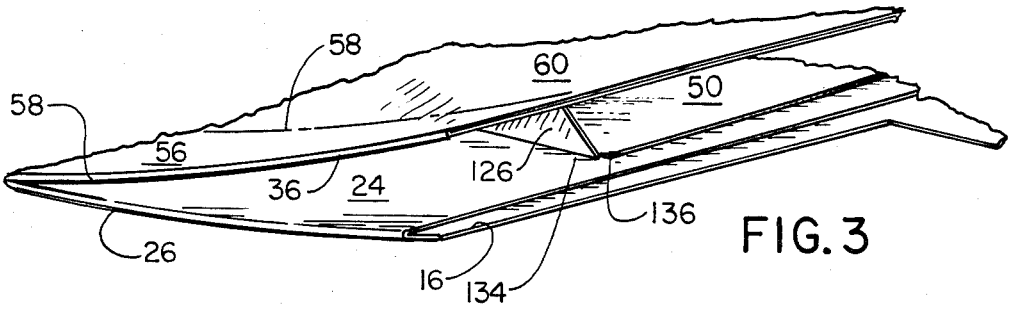
FIG. 3 is a pictorial view of relative parts during one of the folding operations.

The next folding operation, a significant portion of which is illustrated in FIG. 3, comprises folding the carrier blank 2 around the center fold line 40. During the folding operation, as riser panel 36 moves toward riser panel 24 and reinforcing tab 50, the linear abutment edge 134 of the abutment tab 126 moves into contact with the linear abutment edge 136 formed on reinforcing tab 50. A skewing force is applied to riser panel 36 to ensure that contact is made by linear abutment edge 134 with linear abutment edge 136. The abutment edges 134 and 136 are located so that as the folding operation is continued, the edges 26 and 58 are forced into a proper superposed and aligned relationship. This also ensures that the edges 66 and 80 are in a proper superposed and aligned relationship.

Figure 4:
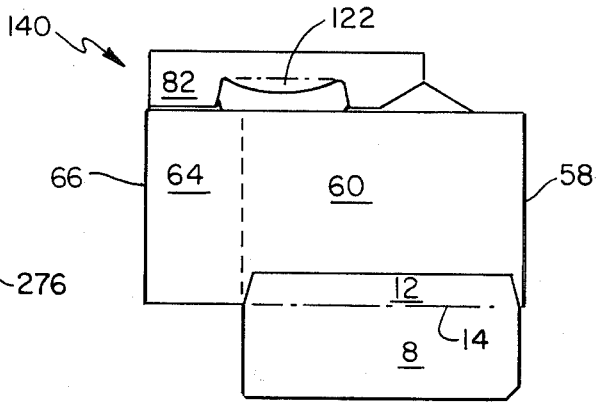
FIG. 4 is a plan view of a fully folded carrier blank of FIG. 1 in a collapsed condition.

The completely folded blank 140 is illustrated in FIG. 4. In the completely folded blank 140, at least a portion of the linear abutment edges 134 and 136 are in contact with each other and the linear abutment edge 134 is parallel to the linear abutment edge 136.

Figure 5:
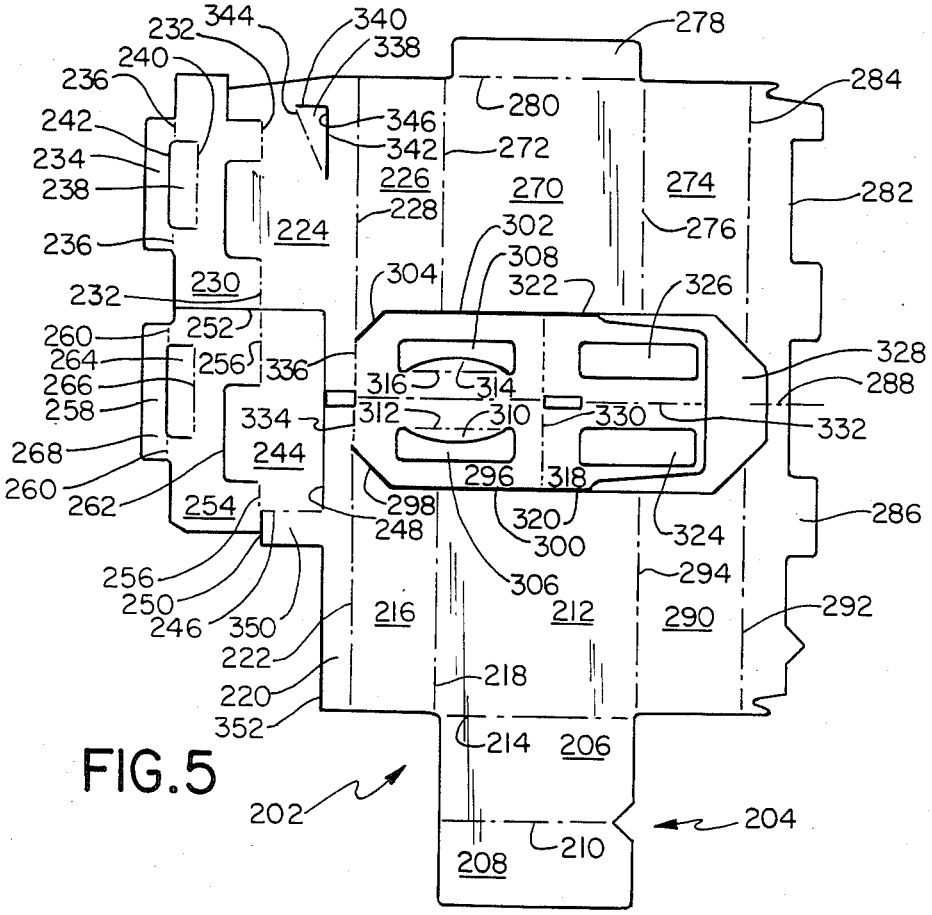
FIG. 5 is a plan view of a carrier blank illustrating another embodiment of the invention.

In FIG. 5, there is illustrated a one piece carrier blank 202 of paperboard material, preferably a composite material, such as that described in U.S. Pat. No. 4,254,173 issued to A. D. Peer, Jr., having glue patterns, fold lines and cut lines illustrated in a conventional manner. A bottom wall panel 204 comprising two sections 206 and 208 connected by fold line 210 is connected to a side wall panel 212 by fold line 214. An end wall panel 216 is connected to side wall panel 212 by fold line 218 and to riser panel 220 by fold line 222. A riser panel 224 is connected to end wall panel 226 by a fold line 228. A partition panel 230 is connected to riser panel 224 by fold lines 232 and is provided with a glue tab 234 secured thereto by fold lines 236. A reinforcing panel 238 is connected to partition panel 230 by fold line 240. A cut line 242 permits the reinforcing panel 238 to be partially separated from the partition panel 230 and folded 180 degrees around fold line 240.

A reinforcing panel 244 is connected to riser panel 220 by fold line 246 and by cut lines 248 and 250 and is connected to riser panel 224 and partition panel 230 by cut line 252. The cut lines 248, 250 and 252 permit the reinforcing panel 244 to be separated from the riser panel 224 and the partition panel 230 and to be partially separated from riser panel 220 and folded 180 degrees around fold line 246. A partition panel 254 is connected to reinforcing panel 244 by fold lines 256 and is provided with a glue tab 258 connected thereto by fold lines 260. A cut line 262 permits the partition panel 254 to be partially separated from reinforcing panel 244 so that it may be folded around fold lines 256. A reinforcing panel 264 is connected to partition panel 230 by fold line 266. A cut line 268 permits the reinforcing panel 264 to be partially separated from the partition panel 254 and folded 180 degrees around fold line 266.

A side wall panel 270 is connected to end wall panel 226 by fold line 272 and to end wall panel 274 by fold line 276. A glue tab 278 is connected to side wall panel 270 by fold line 280. A riser panel 282 is connected to end wall panel 274 by fold line 284 and to a riser panel 286 by fold line 288. An end wall panel 290 is connected to riser panel 286 by fold line 292 and to side wall panel 212 by fold line 294.

A handle portion 296 is formed in the carrier blank 202 by cut lines 298, 300, 302 and 304 and openings 306 and 308 are cut out of the carrier blank 202. A tab 310 is connected to the handle portion 296 by fold line 312 and a tab 314 is connected to the handle portion 296 by a fold line 316. A reinforcing panel 318 for reinforcing the handle portion 296 is formed in the carrier blank 2 by cut lines 320 and 322. Openings 324, 326 and 328 are cut out of the carrier blank 202. The reinforcing panel 318 is connected to the handle portion 296 by fold lines 330. A center fold line 332 extends throughout the handle portion 296 and the reinforcing panel 318. The riser panel 220 is connected to the handle portion 296 by fold line 334 and the riser panel 224 is connected to the handle portion 296 by fold line 336.

A significant part of this embodiment of the invention comprises an abutment tab 338 formed in riser panel 224 by linear cut lines 340 and 342 and connected to riser panel 224 by fold line 334. The linear cut line 342 functions to form a linear abutment edge 346 on the abutment tab 338 for a purpose described below.

Figure 6:
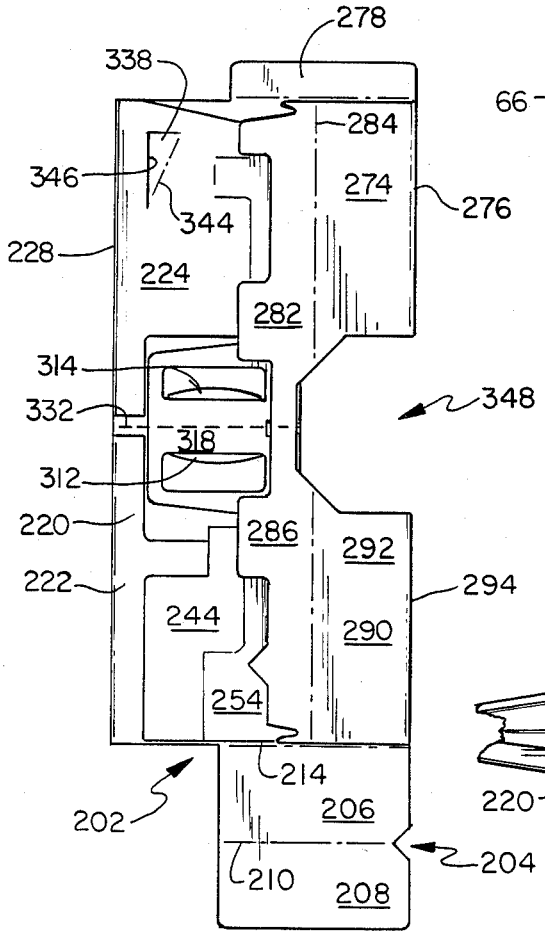
FIG. 6 is a plan view after a plurality of folds have been made in the carrier blank of FIG. 5.

The partially folded carrier 348 illustrated in FIG. 6 is formed by a sequence of severing and folding operations (not illustrated). The partially folded carrier 348 is similar to the partially folded carrier 138. During the sequence of severing and folding operations, the abutment tab 338 is severed along linear cut lines 340 and 342 and partially folded around fold line 334 so as to project outwardly and form the linear abutment edge 346 as illustrated in FIG. 7.

Figure 7:
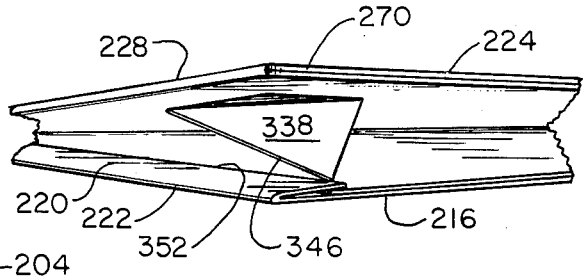
FIG. 7 is a pictorial view of relative parts during one of the folding operations.

The next folding operation, a significant portion of which is illustrated in FIG. 7, comprises folding the partially folded carrier blank 348 of FIG. 6 around the center fold line 332. During the folding operation, as riser panel 224 moves toward riser panel 220, the linear abutment edge 346 of the abutment tab 338 moves into contact with a linear abutment edge 352 formed on the riser panel 220. A skewing force is applied to riser panel 224 to ensure that contact is made by linear abutment edge 346 with linear abutment edge 352. The linear abutment edges 346 and 352 are located so that as the folding operation is continued, the edges 222 and 228 are forced into a proper superposed and aligned relationship. This also ensures that edges 276 and 294 are in a proper superposed and aligned relationship.

Figure 8:
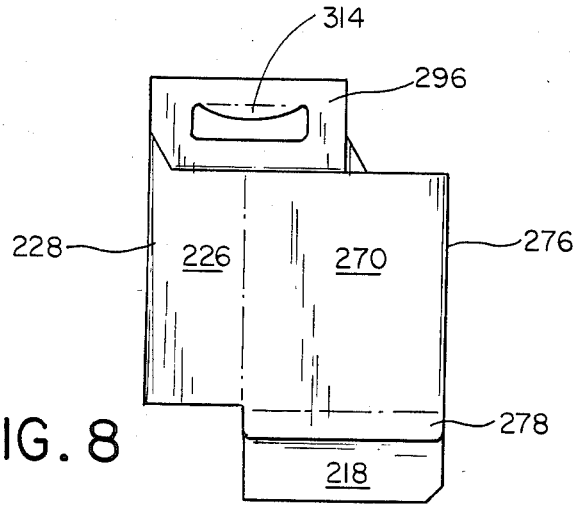
FIG. 8 is a plan view of a fully folded carrier blank of FIG. 5 in a collapsed condition.

The completely folded blank 354 is illustrated in FIG. 8.

It is contemplated that the inventive concepts herein described may be variously otherwise embodied and it is intended that the appended claims be construed to include alternative embodiments of the invention except insofar as limited by the prior art.

What is claimed is:

1. A carrier blank comprising:

a relatively flat carrier blank having in a partially folded condition at least a first portion and a second portion joined together by a fold line with said first and second portions having oppositely facing generally planar surfaces when folded around said fold line so that said first and second portions are in a superposed relationship;

means for forming an abutment tab in said first portion of said carrier blank, said means comprising at least one linear cut line and a fold line;

a portion of said abutment tab projecting out of said generally planar surface of said first portion to form a linear abutment edge from said one linear cut line;

means for forming a linear abutment edge in said second portion of said carrier blank said linear abutment edge in said second portion being parallel to said at least one linear cut line; and said linear abutment edge on said abutment tab and said linear abutment edge in said second portion being located so that as said first portion and said second portion are being folded together, said abutment edges will move into contacting relationship so as to guide the movement of said first and second portions so that when said carrier blank is completely folded with said generally planar surfaces in contacting relationship, at least portions of said abutment edges are in contact with each other and said linear abutment edge on said abutment tab is parallel with said linear abutment edge in said second portion.

2. A carrier blank as in claim 1 and further comprising:

a first linear edge in said first portion;

a second linear edge in said second portion; and said first and second linear edges being located relative to said abutment edges so that said first and second linear edges will be guided into a superposed and aligned relationship by the contact between said abutment edges during the folding of said carrier blank.

3. A carrier blank as in claim 2 wherein said means forming an abutment tab comprises:

a pair of intersecting linear cut lines; and a fold line extending between the ends of said linear cut lines remote from their intersection.

4. A carrier blank as in claim 3 wherein:

said pair of intersecting linear cut lines have different lengths.

5. A carrier blank as in claim 3 and further comprising:

a third linear edge in said first portion;

a fourth linear edge in said second portion; and said third and fourth linear edges being located relative to said abutment edges so that said third and fourth linear edges will be guided into a superposed and aligned relationship by the contact between said abutment edges during said folding of said carrier blank.

* * * * *